United States Patent [19]

McCune, III et al.

[11] Patent Number: 4,798,634

[45] Date of Patent: Jan. 17, 1989

[54] CORROSION RESISTANT WROUGHT STAINLESS STEEL ALLOYS HAVING INTERMEDIATE STRENGTH AND GOOD MACHINABILITY

[75] Inventors: Harry E. McCune, III; Charles A. Divine, Jr., both of Fredonia, N.Y.

[73] Assignee: Al Tech Specialty Steel Corporation, Dunkirk, N.Y.

[21] Appl. No.: 84,321

[22] Filed: Aug. 10, 1987

Related U.S. Application Data

[63] Continuation of Ser. No. 827,969, Feb. 10, 1986, abandoned.

[51] Int. Cl.[4] ..... C22C 38/40

[52] U.S. Cl. ..... 148/325; 420/42; 420/56

[58] Field of Search ..... 148/325; 420/42, 56

[56] References Cited

U.S. PATENT DOCUMENTS 2,384,565 9/1945 Schaufus ..... 420/42

*Primary Examiner*—Deborah Yee

*Attorney, Agent, or Firm*—Niro, Scavone, Haller & Niro & Rockey, Ltd.

[57] ABSTRACT

A stainless steel having well balanced physical properties, including good corrosion resistance, intermediate strength and good machinability and further being readily process and prepared at low cost. To achieve these properties the microstructure is primarily martensite and ferrite with a limited amount of austenite. Elemental compositional ranges are controlled along with the microstructure resulting in defining the approximate compositional/microstructural boundaries in terms of a region in a Schaeffler type Diagram.

13 Claims, 3 Drawing Sheets

CORROSION RESISTANT WROUGHT STAINLESS STEEL ALLOYS HAVING INTERMEDIATE STRENGTH AND GOOD MACHINABILITY

This is a continuation of application Ser. No. 06/827,969, filed 2/10/86, now abandoned.

BACKGROUND OF THE INVENTION

The present invention relates generally to stainless steel alloys and, in particular, to stainless steel alloys having well balanced physical properties, such as good corrosion resistance, intermediate strength and good machinability, and further being easily processed and having a low preparation cost.

A variety of stainless steels are currently utilized in commerce, primarily for applications requiring the strength of steel, but also having excellent corrosion resistance to perform the desired function without degradation of structure and appearance due to a corrosive environment. There are five basic categories of stainless steels; martensitic, ferritic, austenitic, maraging and semi-austenitic. The physical properties of these various categories of stainless steel can be characterized with regard to corrosion resistance, strength, machinability, ease of processing and cost to prepare stock.

Martensitic stainless steels consist essentially of 12–14% by weight of Cr plus other elements to enhance selected specific properties. Hereinafter, elemental percentages are expressed in weight percentages unless otherwise specified. The martensitic stainless steels have the poorest corrosion resistance of all the stainless steels. Martensitic stainless steels can be heat treated to wide strength levels, from low strength to very high strength. The straight Cr alloys, such as a UNS S41000, have good machinability in the annealed condition, or when heat treated to an intermediate strength level. The machinability can be significantly improved by increasing additions of sulfur, such as in a UNS S41600 alloy. The martensitic stainless steels are relatively easy to hot-work, but they must be annealed after the hot working operation. The alloys which contain only Cr and a medium C level are relatively easy to anneal, and the annealing factors are not critical. Because improper processing can result in high hardness and stress cracking, the grades of stainless steel which contain high C and/or Ni require close control of the following process parameters: cooling rate after hot working treatments, annealing temperatures and cooling from the annealing temperature. In the annealed condition the martensitic stainless steels cold-work ather easily and can also be cold worked at a relatively low, intermediate strength level. These martensitic stainless steel alloys are typically heat treated in a two step process. The first step is to austenitize at a high temperature (usually 1700° F. to 2000° F.) and then oil or air quenched to room temperature. In the second step the material is tempered or drawn to the desired strength level at a relatively low temperature (800° F. to 1400° F.). In most situations the tempering time and temperature are quite critical parameters. Generally the martensitic stainless steels tend to be the lowest cost of all of the stainless steels.

Ferritic stainless steels contain about 16–30% Cr and can contain other elements, such as Mo to enhance specific properties. A UNS S43000 stainless ssteel containing 17% Cr has good machinability, and the machinability can be significantly improved with increasing additions of S. The ferritic stainless steels have low strength, and the strength cannot be increased by heat treating. The ferritic stainless steels also have a low rate of work hardening, and the strength cannot be significantly increased by cold working. Ferritic stainless is relatively easy to process in regard to hot working, cold working and annealing. Stainless steels such as the above mentioned US 43000, which are air melted alloys, are relatively inexpensive to produce, but the higher alloy vacuum melted stainless steels, such as UNS S44625, are relatively expensive to produce.

Austentic stainless steels are best exemplified by a UNS S 30400 alloy which is commonly referred to in the art as "18-8". In the austenitic Cr-Ni steels the Cr and Ni contents can vary substantially to meet various applications, and other elements, such as Mn, Si, Mo, Cu, Ti, Cb, and N, can be added to enhance selected properties. These alloys are best known for their excellent corrosion resistance properties. The hot worked or cold worked 18-8 alloy is annealed at about 1800° F.–2000° F., followed by a rapid cooling, typically by water quenching. The austenitic stainless steels cannot be hardened by heat treating, but the strength can be increased by cold working because these alloys have a high rate of work hardening. The alloys are relatively easy to process since they have good hot and cold workability and require only a simple annealing treatment. The austenitic stainless steels are usually higher in cost than the martensitic and ferritic stainless alloys because the necessary raw materials include more expensive higher alloy starting material. The machinability is fair to good and can generally be improved with the addition of S.

The maraging stainless steels are martensitic alloys which have very low carbon plus nitrogen content and can be precipitation hardened. In general these alloys have low percentages of ferrite and retained austenite. Examples of maraging stainless steels are UNS S17400 and UNS S36200 alloys which have good corrosion resistance. In an as solution annealed state these alloys have intermediate strength, and they can be precipitation hardened from an intermediate to a high strength level. The machinability is however rated as being poor, and the maraging steels are not among the easiest alloys to process. The maraging stainless steels also must be melted under carefully controlled chemistry conditions in order to prevent hot working problems and to insure proper response to heat treatment. The cold workability will depend on the alloy and the heat treatment, but this category of steels is usually rated as having fair to poor cold workability. In general there are three basis heat treatments for the maraging alloys: (1) a single or double overage to place the material in condition for optimum cold working or machinability, (2) a solution anneal which is required prior to a precipitation hardening cycle, and (3) a precipitation hardening to a specified strength leve. These alloys are not rated as low cost alloys due in part to the lengthy processing schedule.

The semi-austenitic stainless steels are austenitic in the solution annealed condition, and some alloys of this category may contain up to 20% to 30% ferrite, as solution annealed. By means of several heat treating operations the austentite can be transformed to martensite, and the martensite is usually age hardenable. The chemical composition of steels of this category should be closely controlled in order to produce austenite of the proper stability so that the martensitic transformation will occur. Strength levels from intermediate to high strength are produceable by heat treating. High strength also is produceable by cold working which transforms the austenite to martensite, followed by aging or tempering treatments. Examples of semi-austenitic stainless steels are UNS S17700, UNS S35500 and UNS S15700 alloys. These alloys have good corrosion resistance, but their machinability is rated as poor. The semi-austenitic stainless steels are not easily produced and are not low cost alloys.

Each of the above categories of stainless steels offer various advantages and features, but each generally lacks certain significant properties and none has a well balanced set of physical parameters attainable by using materials of modest cost and straightforward processing methods.

BRIEF SUMMARY OF THE INVENTION

An object of the present invention is to provide an improved stainless steel with well balanced physical properties and produceable at a low cost.

An additional object of the invention is to provide an improved ferriticmartensitic stainless steel alloy which has intermediate tensile strength and good machinability and can be produced by a relatively straightforward steel production process.

A further object is to provide a novel martensitic-ferritic stainless steel alloy which has good corrosion resistance, intermediate tensile strength, uniform hardness across a bar diameter, excellent machinability and produceable at a low cost.

A feature of the stainless steel alloy in accordance with the invention lies in the unique compositional ranges and microstructure of the alloy. The alloy consists essentially by maximum weight percent of 0.08 C, 2.0 Mn, 0.06 P, 0.60 S, 1.0 Si, 2.5 Mo, 4.0 Cu, 0.08 N, 0.10 Al, 0.10 Ti, 0.10 Ta, 0.10 Cb with the sum of Cb, Ta and Ti not exceeding 0.15, and between about 12.0–20.0 Cr and 1.5–7.0 Ni with the balance Fe and conventional impurities. The microstructure of the alloy comprises at least about 20 percent martensite, at least about 10 percent ferrite and a maximum of about 5 percent austenite. References herein to the amount of martensite, ferrite and austenite in the alloys of the present invention are always in volume percentages.

Further objects and advantages of the present invention, together with the organization and manner of operation thereof, will become apparent from the following detailed description of the invention when taken in conjunction with the accompanying drawings and examples.

DETAILED DESCRIPTION OF THE PREFERRED EMBODIMENT

Figure 1:
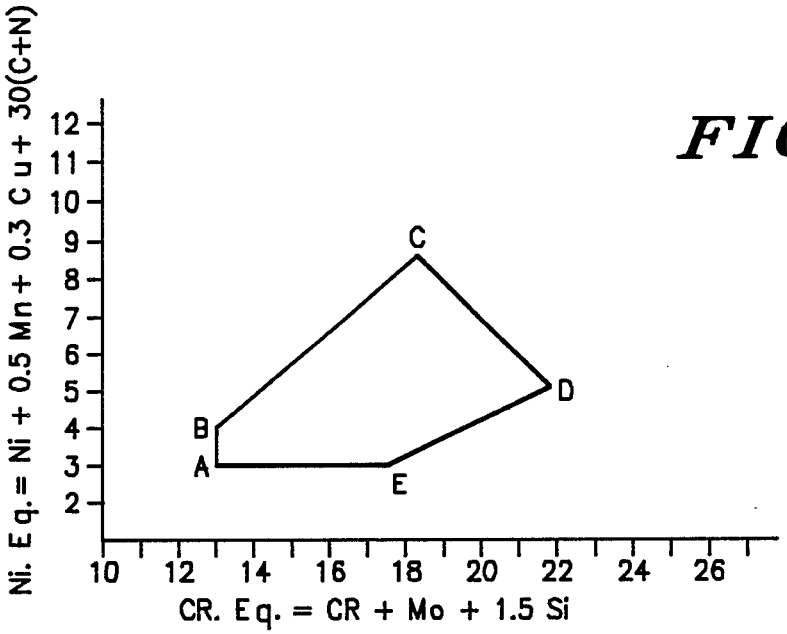
FIG. 1 is a graphical respresentation of the approximate compositional and microstructural boundaries in terms of Ni and Cr Equivalents for the various preferred stainless steel alloy embodiments.

In order to obtain a stainless steel alloy with intermediate strength, at least a reasonable portion of the microstructure should be composed of martensite. The corrosion resistance is primarily a function of the Cr content, and the corrosion resistance increases in direct proportion to the Cr content. The addition of Ni will also improve the corrosion resistance. The presence of ferrite in a primarily two phase microstructure improves the machinability. Tempered martensite has better machinability than does austenite, and unstable austenite can be detrimental to machinability. Therefore, in order to achieve the desired properties the preferred microstructure is primarily martensite and ferrite with a restricted amount of austenite. The alloy preferably has good processig characteristics so that it can be fabricated into semi-finished and finished stock and articles, such as, for example, billets, bars, rod, extrusions, tubing, forging and machined parts. In order to be a commercially viable stainless steel alloy, the production cost should also be kept as low as possible through timely chemical analysis of the alloy, prudent selection of raw materials and by utilizing straightforward processing operations having a minimal number of processings steps.

Each alloying element has a significant effect on the properties and/or the cost of the alloy of this invention. One method of evaluating the effects of an alloying element is its tendency to form ferrite or austenite. The ferrite forming tendency is defined as the "Cr Equivalent" which is expressed as follows:

$$\text{Cr Eq.} = \%\ \text{Cr} + \%\ \text{Mo} + 1.5 \times \%\ \text{Si}.$$

The austentite forming tendency is defined as the "Ni Equivalent" which is expressed as follows:

$$\text{Ni Eq.} = \%\ \text{Ni} + 0.5 \times \%\ \text{Mn} + 0.3 \times \%\ \text{Cu} + 30\ (\%\ \text{C} + \%\ \text{N})$$

Each element in the chemical composition of the alloy of this invention is present either from specific additions or from scrap metal added to prepare the alloy. The control of the relative quantities of these elements is important for the control of the resulting physical properties of the stainless steel alloys. Some of the elements are maintained within specific maximum ranges in order to minimize the detrimental effects on the alloys, and some elements are controlled in order to to provide novel and improved properties. The effects of the various elements are defined in the following separate discussions of the significance of each element.

Carbon

Carbon promotes the formation of austenite at high temperatures. Also, the hardness of the martensite which forms from austentite during cooling from the melt is directly proportional to carbon content. Therefore, the higher the C content the higher the quenched hardness of the martensite. High hardness necessitates inprocess annealing to prevent stress cracking of the material. Restricting the C content as in the instant invention will reduce the quenched hardness of the martensite which in turn will virtually eliminate the susceptibility to stress cracking. Without a tendency for stress cracking there is no need for in-process annealing, and this ultimately reduces the cost to prepare the alloy.

The microstructure of a preferred form of the invention comprises ferrite and tempered martensite at room temperature as a semi-finished product. The ferrite at room temperature has a low solubility for C, and the C in the ferrite is present as a precipitated chromium carbide. When the martensite is tempered to the selected hardness, the C precipitates in the form of chromium carbide. Hard abrasive particles, such as chromium carbide, generally decrease the machinability of the alloys. Therefore, the maximum amount of C is limited to that amount necessary to produce the desired intermediate strength and hardness, while minimizing the amount of precipitated chromium carbide in order to prevent decrease of machinability. Relative to other alloys having similar strength, a minimum amount of chromium carbide in the subject invention results in improved machinability over other alloys. The C content in the alloy of this invention is generally limited to a maximum of about 0.08%.

Manganese

The element Manganese promotes the formation of austenite and is soluble in both ferrite and martensite but is not a carbide former. Mn is not necessarily added to the alloy of this invention for a specific purpose. Cr-Ni and Cr-Mn-Ni stainless steel scrap is a commonly available and relatively inexpensive source of the important alloy elements of Cr and Ni, and Mn is often introduced from the use of such scrap as part of the starting material. The Mn content of most Cr-Ni stainless steels is roughly a maximum of 2.0%, and in Cr-Mn-Ni stainless steels the Mn content can range from about 5.0% to 15.0%. The level of Mn content in an alloy of the instant invention is primarily an economic factor, not a metallurgical factor; and therefore the Mn content is limited to roughly 2.0% maximum based on scrap availability and cost.

Phosphorous

The element Phosphorous occurs in steel based scrap, and in some iron based alloys low P content for some alloys is desirable. Very high P levels can be detrimental to workability of some alloys; however, in this invention P in reasonable amounts is not detrimental. Low P scrap is generally costly to acquire, and thus the P level is primarily an economic factor, provided a high P level is not detrimental to the workability of the alloy. The maximum P level for the preferred embodiment is established at roughly 0.06%.

Sulfur

The element Sulfur commonly occurs in metallic scrap, in various alloying materials and in other steel making materials. S can be removed from molten steel to very low levels and is readily added. It is well known that very low S levels are beneficial for good notch impact strength and for good cold headability. It is also well known that the machinability of steels increases with increasing S content. Further it is known in the art that machinability also increases with the addition of others of the chalcogens, such as Se, and also with moderate P additions. The S level of the alloy of this invention can vary with the selected application of the material. When good cold headability is desired, the S is preferably removed to quite low levels (roughly 0.001%–0.008%), and when good machinability is required, the S is added to achieve reasonably high levels (roughly 0.30%–0.40%). The maximum S level for this invention is preferably about 0.60%.

Silicon

The element Silicon tends to cause formation of the ferrite phase and is also frequently used as a deoxidizer in the melting process. For corrosion resistant aaplications it is usually preferable to use Cr instead of Si to cause ferrite formation because of the better corrosion resistance properties instilled by Cr. High Si content also increases the fluidity of castings and increases the oxidation resistance of the alloy. The maximum Si content of this invention is preferably about 1.0.

Chromium

The element Chromium is one of the primary alloying elements in preparing the stainless steel alloys. Cr promotes the formation of the ferrite phase and is responsible for the bulk of the corrosion resistance of the alloys. The corrosion resistance increases directly as the Cr content increases, and stainless steels require a minimum of about 12% Cr to provide substantialy corrosion resistance. This figure of about 12% Cr also defines the approximate minimum Cr content desired for the Cr content in the various alloys of this invention. However, if the Cr content becomes too high, the structure will become completely ferritic and/or the martensitic reaction will be suppressed, resulting in an excessive and detrimental amount of the austenite phase. Therefore, the Cr content for this invention ranges from roughly 12.0% to about 20.0%.

Nickel

The element Nickel is one of the primary alloying elements of this invention, and the preferre range of Ni is 1.5% to 7.0%. Ni promotes the formation of the austenite phase at high temperatues above the austenite transformation temperature. However, if the Ni content is too high, the martensite reaction will be suppressed resulting in an excessive and detrimental amount of austenite. Furthermore, high Ni content can also eliminate the ferrite phase from the structure. Consequently, the Ni content is adjusted to generate the desired proportions of austenite, ferrite and martensite given the chemical composition and the process parameters.

For quantities of at least about 1.0% Ni there is a significant increase in the hardenability of martensitic stainless steels, such that large sections will uniformly harden upon air cooling. Consequently, preferred compositions of Ni in the alloys will uniformly harden the material upon air cooling after hot working. This air hardening capability has the following advantages: a uniform intermediate hardness or strength results regardless of cross section or mass, an austenitizing or solution hardening treatment is eliminated, oil or water quenching is eliminated and the processing costs are reduced.

One of the important functions of Ni in the preferred alloys is to assist in the improvement of the corrosion resistance, and an increasing nickel content results in an increase in the corrosion resistance. Increasing Ni content also however slightly decreases the machinability, but the decrease in machinability is not significant enough to cause a deviation from the desired overall properties of the preferred alloys.

Nickel content within the specified ranges for the various preferred alloys tends to increase the resistance to tempering, that is, the tempering curve of hardness versus tempering temperature has a shallow slope. Therefore, the tempering timetemperature parameters of the preferred alloys are rather broad which increases the reliability of the tempering process and results in a decrease in the costs of producing the alloys.

Molybdenum

The element Molybdenum generally promotes the formation of ferrite and can be introduced by use of stainless steel scrap as a starting material which typically contains Mo. A high Mo residual content for some types of stainless steel alloys is not acceptable, and the necessity to utilize high quality scrap in these types of alloys causes an increase in the cost of production. However, for the preferred embodiments of the alloys herein the Mo residual content is not critical; therefore, the alloy cost is lowered by allowing the use of Mo contaminated scrap or by avoiding the necessity of scrapping a heat because of a high Mo residual content.

It is well known that Mo additions to stainless steels will usually increase the corrosion resistance, and corrosion data confirms that Mo additions to the preferred alloys of this invention also improve the corrosion resistance. The corrosion resistance can be improved for specific applications through the addition of Mo aty an increase in cost. Balancing the cost factors against the improved properties, such as increased corrosion resistance with increased Mo content, the preferred Mo content is a maximum of about 2.5%.

Copper

The element Copper promotes the formation of austenite at high temperature. There are several grades of stainless steel which contain about 1.0% to 4.0% of Cu. When scrap containing large amounts of Cu is accidentially mixed with low Cu scrap, a high Cu residual can result for the alloy. However, a high Cu residual is not detrimental to the properties of the preferred alloys, and this enables reduction of the cost of producing the various preferred alloys.

It is known that when Cu is added to stainless steel, the corrosion resistance usually tends to improve. Data taken on the preferred alloys verifies that Cu improves the corrosion resistance, and Cu can be added within a specified range to achieve improved corrosion resistance for a selected application.

A saturated solid solution of Cu in the martensite phase can be utilized to provide a precipitation hardened alloy wherein Cu is the precipitate. The preferred alloys herein which have high Cu can be precipitation hardened, but a high hardness and high strength cannot be obtained because of the relatively large amount of the ferrite phase. In the preferred alloys the maximum Cu content is roughly 4.0%.

Nitrogen

The element Nitrogen has substantially the same characteristics as C in the preferred alloys. Nitrogen will promote the formation of the austenite phase at high temperatures, and the hardness of the martensite is a direct function of the N content. The N content is restricted to limit the maximum quenched hardness, and a lower quenched hardness eliminates the susceptibility to stress cracking and the need for intermediate or process annealing steps which contributes to lower production cost.

The N content should also be restricted in order to limit the amount of chromium nitride which precipitates in the ferrite and tempered martensite phases. Chromium nitride is a hard abrasive phase which is detrimental to machinability. The amount of chromium nitride is restricted by limiting the N content, and the N content in the preferred alloys is limited to about 0.08% maximum.

Aluminum

The element Aluminum readily combines with oxygen and nitrogen to form hard abrasive particles of aluminum oxide or aluminum nitride, both of which are detrimental to machability. Al is an excellent deoxidizer and is sometimes used as a deoxidizer in some melting practices. In order to obtain the optimum machinability, the residual Al content in the alloy of this invention is preferably restricted to about 0.10% maximum.

Columbium, Tantalum, and Titanium

The three elements Cb, Ta and Ti all form very stable, hard, abrasive oxides, carbides and nitrides which are generally detrimental to machinability. Therefore, these three elements are not intentionally added by themselves to the preferred alloys. These elements however could be present in scrap, in various alloying materials and as risidual elements in other steel making materials. The maximum amount of Cb, Ta, or Ti in the preferred composition is roughly 0.10 maximum for each element, and the preferred maximum total amount of all three elements is roughly 0.15%.

Preferred Property Combinations

A broad chemistry range exists which encompasses the preferred combination of properties for the desired alloys, and there is a preferred chemistry range which covers the optimum combination of properties for the preferred alloys. The following table lists the chemical makeup of these two alloy compositional ranges in terms of approximate preferred range.

Preferred Alloy Compositions

| Chemical Element | Preferred Range | Broad Range |
|---|---|---|
| C | .05 max. | .08 max. |
| Mn | 2.00 max. | 2.00 max. |
| P | .04 max. | .06 max. |
| S | .50 max. | 0.60 max. |
| Si | 1.00 max. | 1.00 max. |
| Cr | 14.00–19.00 | 12.00–20.00 |
| Ni | 2.50–5.50 | 1.50–7.00 |
| Mo | 2.00 max. | 2.50 max. |
| Cu | 3.00 max. | 4.00 max. |
| N | .05 max. | .08 max. |
| Al | .10 max. | .10 max. |
| Ti | .05 max. | .10 max. |
| Cb | .05 max. | .10 max. |
| Ta | .05 max. | .10 max. |
| Ti + Cb + Ta | .10 max. | .15 max. |

In addition the alloys of the preferred embodiment can be further described by qualifying the approximate range of the primary crystallographic phases which contribute to the optimum combinations of machinability and intermediate strength. The approximate preferred ranges for these crystallographic phases are at least about 20% martensite, at least about 10% ferrite and a maximum of about 5% austenite. The minimum quantity of about 20% martensite is desirable in order to produce intermediate strength and hardness. The minimum quantity of about 10% ferrite and the maximum quantity of about 5% austenite are desirable to insure good machinability.

FIG. 1 is a graphical representation of the approximate chemical composition and crystallographic structure components of the preferred alloys. FIG. 1 is constructed in accordance with the known teachings of a Schaeffler Diagram (see, Metals Handbook, vol. 6, 8th Edition, page 246, FIG. 1 and text therein descriptive of the figures, which is incorporated by reference herein). This invention normally falls within the area ABCDE shown in FIG. 1. The line AE having the Ni Equivalent co-ordinate of 3.0 defines a Ni content of 1.5% plus minimum C, Mn, Cu, and N residuals. The line AB has the Cr Equivalent co-ordinate of 13.0 and corresponds to a minimum Cr content of 12.0% plus minimum Si and Mo residuals. The line BC corresponds to the position of a 10% ferrite line: there is less than about 10% ferrite above the line BC, and there is more than about 10% ferrite below the line BC. The line DE illustrates the 20% martensite line: there is less than about 20% martensite below the line DE, and there is more than about 20% martensite above the line DE. The 10% ferrite line BC and the 20% martensite line DE are constructed in accordance with the Schaeffler Diagram technique and have been verified by metallographic examination for ferrite and martensite phases present in 1.5"×1.0" hot rolled bars. Retained austenite is not readily visible during metallographic examination and therefore is determined typically by means of X-Ray diffraction. The temperature at which the martensite reaction is completed or finished, (hereinafer, $M_f$), was determined by a dilatometer on a number of steel heats, and it was determined that a linear relationship existed between the $M_f$ temperature and the sum of the Cr Equivalent plus the Ni Equivalent. In order to maintain the retained austenite at about 5% maximum, the $M_f$ temperature should roughly be above room temperature.

The $M_f$ temperature of a given steel heat is a function of the cemical analysis, the percentage of elements in solid solution, the cooling rate and various known microsegregation effects. Therefore, the preferred estimated $M_f$ temperature for keeping retained austenite to a maximum of about 5% austenite is roughly 140° F.

To those skilled in the art of stainless steel metallurgy it is well known that the amounts of ferrite, austenite and martensite are a function not only of the chemical analysis but also of the processing schedule and the location of the specimen section in the stock. Consequently, alloys of the preferred chemistry range for this invention can have the microstructures specified hereinbefore but still fall outside the area ABCDE in FIG. 1 and thus still comprise the subject invention. For example, an alloy heat having the previously defined broad chemistry range could be above the line BC and have more than 10% ferrite if a 16 inch square ingot is heated to 2350° F., hot rolled to form a 14 inch square billet, air cooled and the ferrite phase content measured at the centerline. In another example an annealed rod of a heat within the broad chemistry range of the invention could fall above line CD, but when the rod is given a large cold reduction the retained austenite will transform to martensite. Thus, the cold drawn wire will contain less than 5% austenite. It is therefore possible by various processing practices to produce a finished state produce which has passed through the boundaries in FIG. 1 or the product is in the specified preferred chemistry range but not the specified microstructures (or vice versa) and still define a product alloy which is within the conceived embodiments of the inventions.

The invention will be illustrated by reference to the following examples but are not to be construed as defining the limitations of the invention.

EXAMPLE I

Stainless steel heats listed in Table I were prepared by melting fifty pound charges using a vacuum induction furnace. Table I lists the chemical compositions of these heats, the Cr and Ni Equivalent and the percent of ferrite after hot rolling at 2300° F. on a fourteen inch bar mill. Table II lists the as hot-worked properties of these heats, describing the test piece size, Brinell Hardness Number and the percentage of ferrite.

TABLE 1

| | Chemical Composition of Alloys | | | | | | | | | | | | |
|---|---|---|---|---|---|---|---|---|---|---|---|---|---|
| Heat No. | C | Mn | P | S | Si | Cr | Ni | Mo | Cu | N | Cr Eq. | Ni Eq | Hot Rolled % Ferrite |
| 8731 | .043 | .72 | .024 | .405 | .31 | 15.63 | 1.55 | .29 | .26 | .026 | 16.4 | 3.9 | 40 |
| 8732 | .042 | .73 | .024 | .404 | .33 | 16.83 | 1.55 | .29 | .29 | .019 | 17.3 | 3.8 | 60 |
| 8733 | .042 | .73 | .024 | .387 | .36 | 17.94 | 1.55 | .29 | .29 | .027 | 18.8 | 4.1 | 75 |
| 8735 | .046 | .67 | .030 | .327 | .32 | 15.44 | 2.65 | .30 | .28 | .041 | 16.2 | 5.7 | 25 |
| 8736 | .046 | .71 | .029 | .357 | .34 | 16.72 | 2.64 | .30 | .28 | .041 | 17.5 | 5.6 | 35 |
| 8737 | .044 | .71 | .026 | .373 | .36 | 18.06 | 2.54 | .28 | .24 | .043 | 18.9 | 5.6 | 60 |
| 8738 | .043 | .70 | .028 | .379 | .33 | 15.45 | 3.61 | .29 | .28 | .043 | 16.2 | 6.6 | 10 |
| 8739 | .046 | .71 | .027 | .349 | .35 | 16.89 | 3.51 | .28 | .24 | .041 | 17.7 | 6.5 | 25 |
| 8740 | .046 | .72 | .025 | .355 | .36 | 18.09 | 3.51 | .27 | .24 | .037 | 18.9 | 6.4 | 35 |
| 8730 | .023 | .71 | .023 | .398 | .30 | 16.85 | 3.40 | .29 | .95 | .021 | 17.6 | 5.3 | 35 |
| 8728 | .020 | .72 | .022 | .397 | .33 | 16.85 | 2.95 | .29 | 1.85 | .018 | 17.6 | 5.0 | 30 |
| 8727 | .023 | .70 | .022 | .349 | .32 | 16.85 | 2.59 | .29 | 2.82 | .020 | 17.6 | 5.1 | 35 |
| 8747 | .022 | .72 | .028 | .362 | .36 | 16.67 | 2.72 | .29 | 2.75 | .022 | 17.5 | 5.2 | 40 |
| 8741 | .040 | .70 | .034 | .354 | .35 | 16.07 | 2.56 | .97 | .24 | .040 | 17.6 | 5.4 | 40 |
| 8742 | .040 | .70 | .043 | .357 | .33 | 14.77 | 2.70 | 1.90 | .27 | .033 | 17.2 | 5.4 | 45 |
| 8729 | .020 | .70 | .021 | .393 | .33 | 15.54 | 3.00 | 1.50 | 1.41 | .020 | 17.5 | 5.0 | 40 |
| 9394 | .018 | 1.24 | .017 | .004 | .33 | 17.39 | 4.03 | .19 | .19 | .010 | 18.1 | 5.5 | |

TABLE II

| | AS HOT WORKED PROPERTIES | | |
|---|---|---|---|
| Heat No. | Test Piece Size | Hardness BHN | % Ferrite |
| 8731 | 1.5" × 1.0" | 302 | 40 |
| 8732 | " | 269 | 60 |
| 8733 | " | 229 | 75 |
| 8735 | " | 341 | 25 |
| 8736 | " | 321 | 35 |
| 8737 | " | 269 | 60 |
| 8738 | " | 363 | 10 |
| 8739 | " | 341 | 25 |
| 8740 | " | 311 | 35 |
| 8730 | " | 302 | 35 |
| 8728 | " | 302 | 30 |
| 8727 | " | 293 | 35 |
| 8747 | " | 293 | 40 |
| 8741 | " | 321 | 40 |
| 8742 | " | 321 | 45 |
| 8729 | " | 302 | 40 |
| 9394 | 2.5" Sq. | 321 | |

The vacuum induction melted ingots were cast into four inch square cross sectional ingots. Ingots from these heats were heated to 2300° F., pressed on a 500 ton hydraulic press to a two and one-half inch square billet and air cooled. The surfaces of the billets were ground to remove surface defects and scale, and were examined for "hot top" defects using an ultrasound testing device. Defective material was cut from each of the billets. The remaining billets were then heated to 2300° F. and each of the billets was hot rolled on a fourteen inch bar mill to a 1.5 inch by 1.0 inch cross sectional stock and was air cooled. The resulting stock was annealed at 1000° F. for two hours and air cooled. The tensile strength and Brinell hardness, respectively, for the heat numbers 8731 to 9394 from Table I are shown in Table III. Note that the intermediate strength of 100,000 to 160,000 psi tensile strength corresponds to Brinell Hardness Numbers of about 207 to 363. In order to eliminate intermediate annealing steps and to prevent stress cracking of castings, ingots, blooms, billets, bars and rod after casting or hot rolling, the maximum preferable tensile strength is about 160,000 psi, or about a 363 Brinell Hardness Number.

The hot worked material hardens upon air cooling and should be stress relieved or tempered prior to producing a finished piece of work in accordance with good metallurgical practice. Most of the heats are noticeably insensitive to the tempering temperature. This improved resistance to tempering improves the reliability during tempering, decreases the incidence of reheat treating and reduces production costs. Approximately 1000° F. is a desirable tempering temperature, and the data in Table III verifies that the various alloys in Table I are hot workable and can be tempered near 1000° F. to produce the desired intermediate strength values.

TABLE III

HOT WORKED PLUS 1000° F. TEMPER PROPERTIES

| Heat No. | Test Piece Size | Tensile Strength | Hardness BHN |
|---|---|---|---|
| 8731 | 1.5" × 1.0" | 123,000 PSI | 262 |
| 8732 | " | 115,000 PSI | 248 |
| 8733 | " | 106,000 PSI | 223 |
| 8735 | " | 136,000 PSI | 285 |
| 8736 | " | 130,000 PSI | 262 |
| 8737 | " | 123,000 PSI | 248 |
| 8738 | " | 141,000 PSI | 285 |
| 8739 | " | 136,000 PSI | 277 |
| 8740 | " | 130,000 PSI | 262 |
| 8730 | " | | 285 |
| 8728 | " | | 285 |
| 8727 | " | | 302 |
| 8747 | " | | 302 |
| 8741 | " | 130,000 PSI | 277 |
| 8742 | " | 135,000 PSI | 285 |
| 8729 | " | | 293 |
| 9394 | " | | 277 |

The machinability of the alloys is partly a function of the amount of precipitated carbides and nitrides which generally diminish machinability. Therefore, the C, N, Ti, Cb and Ta contents are preferably at the low levels set forth in Table VIII. Further, the residual Al is also preferably kept quite low since aluminum oxides and nitrides are also quite abrasive. The amount of the ferrite phase in an alloy is also a factor but is usually not the dominant one in determining machinability.

Machinability in these stainless steel alloys is measured using a known procedure, a "Drill Test". References to good machinability shall generally be construed in terms of the machinability for the alloys of the invention as set forth in the specification, including the examples herein. This test involves drilling at selected speeds of surface feet per minute (SFM hereinafter) and determining the drill lifetime in terms of total inches of material drilled before drill bit failure. In Table IV is illustrated the chemical composition and the Drill Test results performed on a low sulfur version of the preferred embodiment and compared with S41000, a commercial grade martensitic steel, and S30400, a commercial grade austenitic steel. It can be concluded that at the same sulfur and hardness level the machinability of the low sulfur alloy of the instant invention is equal or superior to the S41000 alloy. Further, the alloy machinability is equal or superior to the machinability of the S30400 alloy having lower hardness and higher sulfur content. It is generally accepted that high sulfur content will improve machinability and higher hardness will diminish machinability. Consequently, at roughly the same sulfur level the embodiments of the invention will have better machinability than the S30400 alloy.

The influence of Cr, Ni, Mo and Cu on the machinability of this invention was investigated next. Steel heats were prepared having the compositions listed in Table I, and also one heat of the S30300 alloy and two heats of the S41600 alloy were prepared.

TABLE IV

EFFECT OF LOW S ON MACHINABILITY
CHEMICAL COMPOSITION OF ALLOYS DRILL TESTED

| Grade | Heat No. | C | Mn | P | S | Si | Cr | Ni | Mo | Cu | N | Hardness |
|---|---|---|---|---|---|---|---|---|---|---|---|---|
| Instant Alloy | 9394 | .018 | 1.24 | .017 | .004 | .33 | 17.39 | 4.03 | .19 | .19 | .010 | 277 BHN |
| S41000 | 97820 | .135 | .53 | .020 | .004 | .24 | 11.80 | .40 | .17 | .08 | .042 | 277 BHN |
| S30400 | 0A0800 | .066 | 1.12 | .026 | .022 | .41 | 18.29 | 8.12 | .46 | .49 | .052 | 170 BHN |

DRILL TEST RESULTS

| Grade | Heat No. | Drill Speed (SFM) | Inches Drilled Before Failure |
|---|---|---|---|
| Instant Alloy | 9394 | 150.0 | 3.5 |
| Instant Alloy | " | 100.0 | 66.7 |
| Instant Alloy | " | 97.5 | 108.67 |
| S41000 | 97820 | 150.0 | 6.0 |
| S41000 | " | 100.0 | 28.5 |
| S41000 | " | 92.0 | 49.1 |
| S41000 | " | 85.0 | 97.1 |
| S30400 | 0A0800 | 150.0 | 0.75 |
| S30400 | " | 100.0 | 3.2 |
| S30400 | " | 90.0 | 65.9 |

Samples from each heat were then subjected to the Drill Test for machinability. The chemistry analyses of the S30300 and S41600 alloys are listed in Table V. The Drill Test data on these heats, as well as the Table I heats are listed in Table VI. Heats 8730, 8728, 8727, 8747, and 8729, which have larger Cu content, were solution annealed at 1900° F. and this caused a slightly higher hardness compared to the balance of the heats. The rest of the heats in this investigation were tempered at 1000° F. The S30300 and S41600 alloys were heat treated and processed as noted in Table VI. The data in Table VI demonstrates that the alloys having low Cu in the preferred embodiments all have better machinability than the heat treated S30300 and S41600 alloys. Furthermore, several heats (8731, 8732 and 8733) have machinability substantially equivalent to annealed S41600; and the solution annealed higher content Cu, higher hardness alloys of the preferred embodiments of this invention have machinability substantially equivalent to the S30300 alloy.

The corrosion resistance of an alloy cannot be evaluated by one or two relatively simple tests because of the large number of variables and corrosive environments. Some of these metallurgical variables are: annealing or heat treating, microstructure, cleanliness and cold work. Some prominent ones of the many corrosion variables are: environment (air, steam, water, salt water, reducing acids, oxidizing acids, etc.), chemical composition and concentrations, temperature, time, pH, surface condition and method of measurement. Table VII lists the corrosion data for two corrosion tests for heats of some of the preferred alloys of this invention and for several commercial grade stainless steels. Two corrosion tests were run and were based on anodic polarization tests. One test is in a NaCl solution wherein resistance to chloride pitting is tested, and the second test is performed in $H_2SO_4$ acid to test for general corrosion resistance.

TABLE V

"ALLOY CHEMISTRY FOR MACHINABILITY TESTS"

| Grade | Heat No. | C | Mn | P | S | Si | Cr | Ni | Mo | Cu | N |
|---|---|---|---|---|---|---|---|---|---|---|---|
| S30300 | 06771 | .056 | 1.20 | .025 | .282 | .56 | 17.85 | 8.63 | .32 | .27 | .079 |
| S41600 | 93610 | .120 | .89 | .021 | .325 | .47 | 12.79 | .37 | .05 | .07 | .036 |
| S41600 | 95987 | .126 | .90 | .019 | .323 | .43 | 12.97 | .32 | .04 | .09 | .059 |

TABLE VII

CORRISON DATA

| Grade | Heat No. | 1000 ppm C7—NaCl) pH 5, R.T. Volts Vs. Sce $E_o$ (Note 1) | 1 N $H_2SO_4$ R.T. ma/cm$^2$ 1C (Note 2) |
|---|---|---|---|
| Instant Alloy | 8731 | +.22 | 2.6 |
| " | 8732 | +.23 | 2.4 |
| " | 8733 | +.15 | 2.7 |
| " | 8735 | +.30 | 1.95 |
| " | 8736 | +.23 | 1.9 |
| " | 8737 | +.27 | 1.9 |
| " | 8738 | +.26 | 1.55 |
| " | 8739 | +.35 | 1.4 |
| " | 8740 | +.43 | 1.6 |
| " | 8730 | +.19 | 0.95 |
| " | 8728 | +.12 | 1.1 |
| " | 8727 | +.035 | 0.65 |
| " | 8747 | +.07 | 0.66 |
| " | 8741 | +.25 | 1.3 |
| " | 8742 | +.27 | 0.80 |
| " | 8729 | +.23 | 0.43 |
| S41600 (Annealed) | 93610 | +.06 | >100.0 |
| S41600 (Heat Treat) | 95987 | +.14 | 20.0 |
| S43020 | 94181 | +.32 | 8.8 |
| S30300 | 06771 | +.41 | 1.4 |

Figure 2:
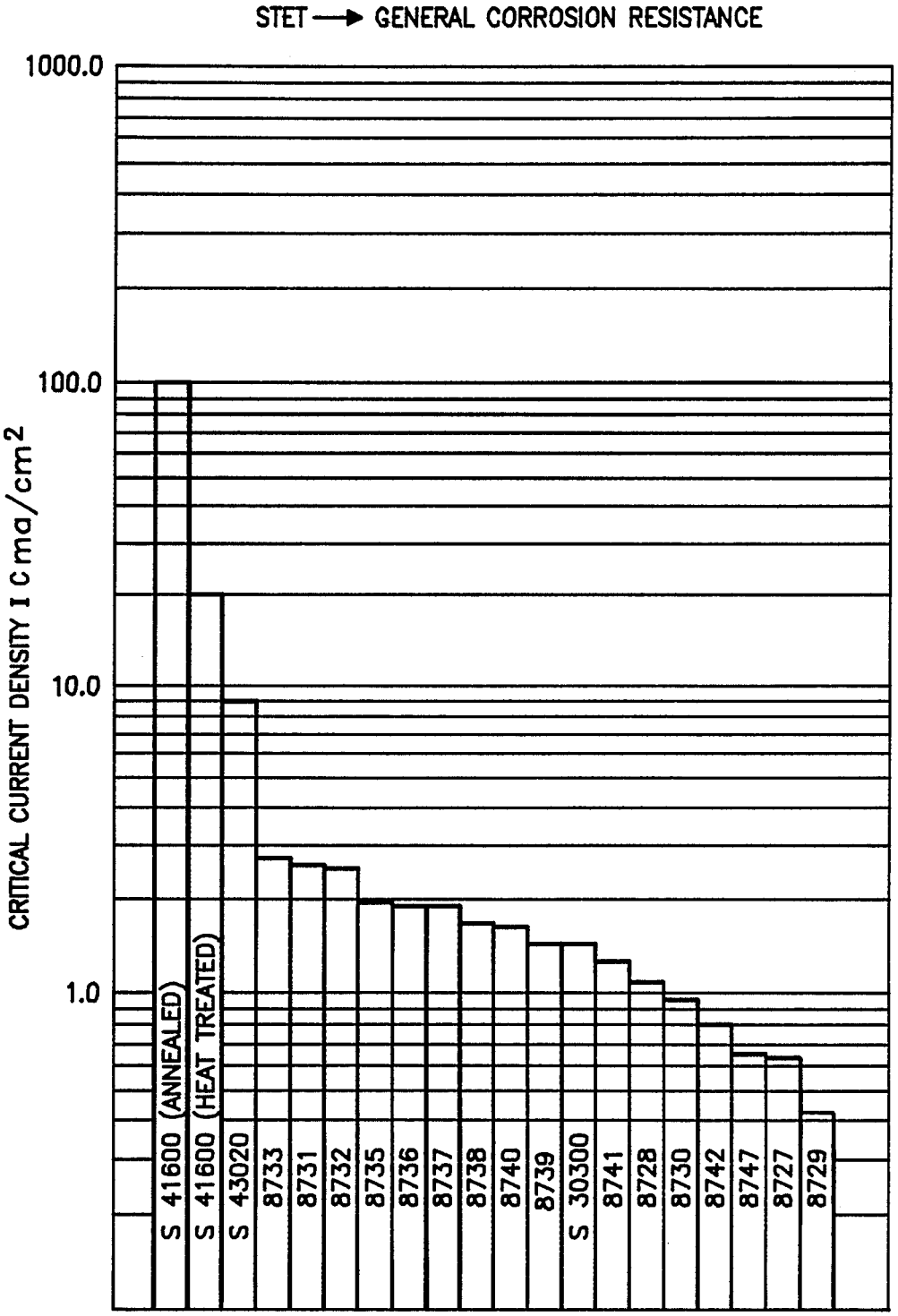
FIG. 2 shows corrosion resistance of selected alloys in terms of critical current density for the alloys.
Figure 3:
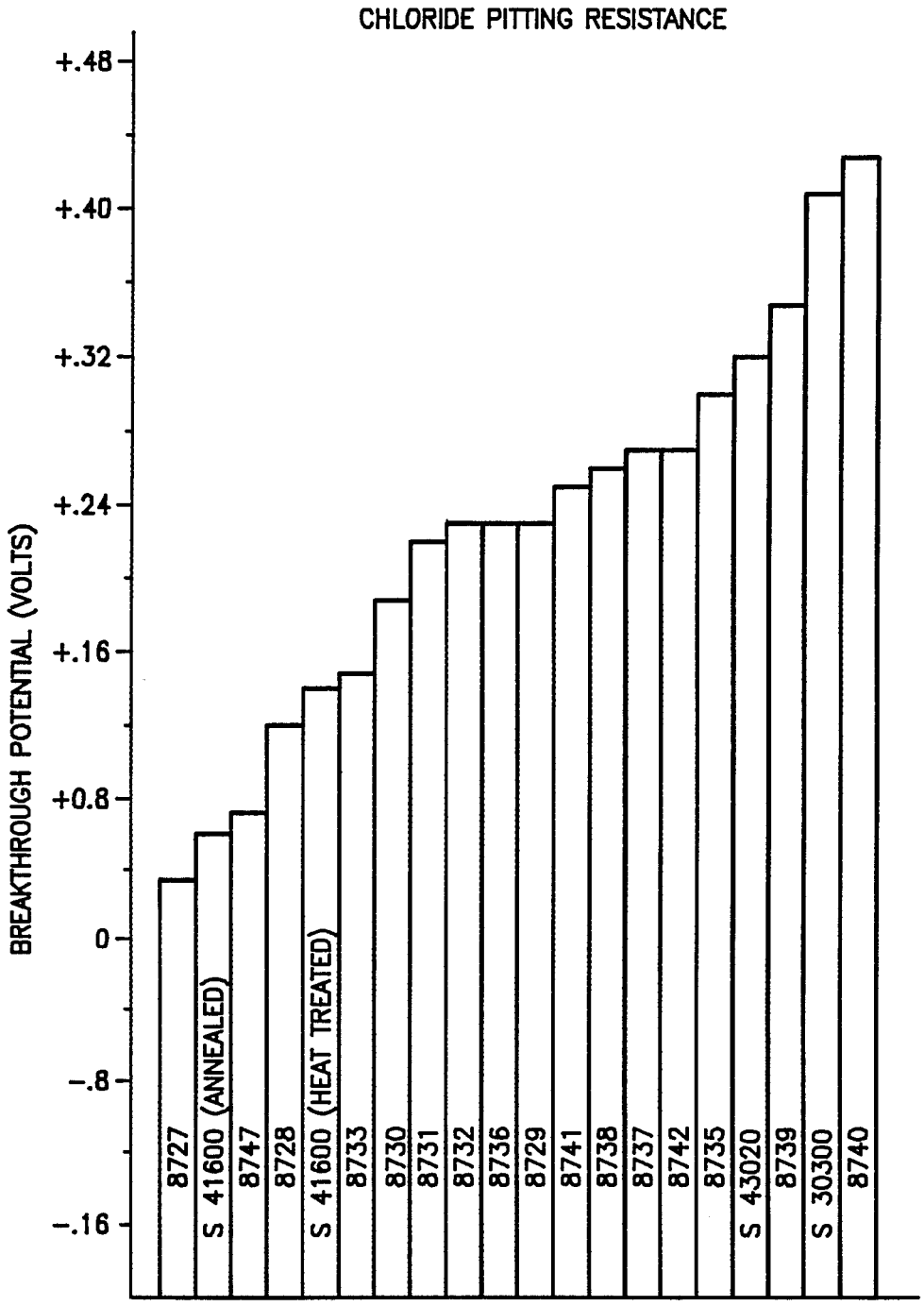
FIG. 3 illustrates corrosion resistance of selected alloys in terms of breakthrough potential for the alloys.

Note 1 - High Values: Good Corrosion Resistance
Note 2 - Low Values: Good Corrosion Resistance FIGS. 2 and 3 are bar graphs of the associated corrosion data from Table VII. FIG. 3 shows that the S41600 alloy has poor pitting resistance. The higher content Cu bearing heats and the lower content Ni heats have poor pitting resistance, but the higher content Cu bearing heats were solution annealed. The higher content Cr-Ni heats have pitting resistance comparable to the S43020 and S30300 alloys.

From FIG. 2 it can be seen that the S41600 and S43020 alloys have generally poor corrosion resistance (the lower the critical current density, the better the corrosion resistance). The heats of preferred alloys of

TABLE VI

EFFECT OF CHEMISTRY ON MACHINABILITY DRILL SPEED VERSUS INCHES DRILLED

| Grade | Heat No. | Drill Speed (SFM) 350 | 325 | 300 | 275 | 250 | 225 | Hardness |
|---|---|---|---|---|---|---|---|---|
| Instant Alloy | 8731 | 14.0 | 25.2 | 31.7 | | | | 262 BHN |
| " | 8732 | 8.6 | 28.0 | 61.3 | | | | 248 BHN |
| " | 8733 | 8.5 | 21.7 | 42.0 | | | | 223 BHN |
| " | 8735 | | 4.5 | 21.5 | 56.3 | | | 285 BHN |
| " | 8736 | 1.5 | 12.7 | 14.5 | 69.7 | | | 262 BHN |
| " | 8737 | | 2.2 | 5.2 | 73.7 | | | 248 BHN |
| " | 8738 | | 2.2 | | 19.2 | 27.0 | | 285 BHN |
| " | 8739 | | 3.2 | | 7.5 | 43.1 | 34.5 | 277 BHN |
| " | 8740 | | 3.5 | | 9.7 | 18.2 | 39.7 | 262 BHN |
| " | 8730 | | 0.7 | | 8.7 | 4.7 | 25.5 | 302 BHN |
| " | 8728 | | 1.5 | | 7.5 | 7.7 | 14.7 | 311 BHN |
| " | 8727 | | 0.7 | | 9.5 | 7.7 | 14.7 | 302 BHN |
| " | 8747 | | 1.9 | | 4.0 | 15.2 | 16.0 | 302 BHN |
| " | 8741 | | 2.2 | | 23.4 | 51.6 | | 277 BHN |
| " | 8742 | | 2.2 | 7.0 | 20.2 | 37.9 | | 285 BHN |
| " | 8729 | | 1.5 | | 5.2 | 7.1 | 23.7 | 293 BHN |
| S30300[1] | 06671 | | | 0.7 | 0.7 | 7.2 | 13.0 | 217 BHN |
| S41600[1] | 93610 | 8.7 | 24.2 | 34.7 | | | | 187 BHN |

this invention have significantly better general corrosion resistance than the S41600 and S43020 alloys. The heats with higher Cr and Ni content have corrosion resistances comparable to the S30300 alloy. Furthermore, the heats of the preferred compositions of this invention with Cu, Mo, or Cu-Mo have generally better corrosion resistance than the S30300 alloy.

EXAMPLE II

This example sets forth alloys prepared in thirty-three ton production size heats in which the charge was melted using the argon-oxygen decarburization ("AOD") practice. In part, this example was prepared to determine whether the good machinability of the alloys in Table IV of Example I were due to small ingot size, small amount of reduction, general cleanliness and sulfide size and distribution. The preferred alloys can be prepared by any generally acceptable preparation process for stainless steel alloys.

Table VIII lists the chemical compositions for the three heats of 33 ton charges. Heats 09427 and 09428 were prepared by using the AOC practice and melting thirty-three ton heats which were cast into sixteen inch square ingots, weighing about 3450 pounds. The ingots were heated to 2350° F., hot rolled to 3.5 inch round-cornered, square billets; and the butt end and hot top were cut off.

TABLE VIII

CHEMICAL COMPOSITION OF ALLOYS

| Heat No. | C | Mn | P | S | Si | Cr | Ni | Mo | Cu | N | Cr. Eq. | Ni. Eq. |
|---|---|---|---|---|---|---|---|---|---|---|---|---|
| 09427 | .015 | 1.20 | .025 | .37 | .39 | 17.38 | 4.02 | .37 | .32 | .018 | 18.3 | 5.8 |
| 09428 | .012 | 1.19 | .021 | .36 | .29 | 17.38 | 2.97 | .22 | 3.32 | .018 | 18.0 | 5.5 |
| 0A1514 | .025 | .99 | .021 | .31 | .49 | 16.68 | 4.12 | .37 | .26 | .016 | 17.8 | 5.9 |

| Note: Heat No. | Al | Cb | Ta | Ti |
|---|---|---|---|---|
| 09427 | .01 | <.01 | <.01 | <.01 |
| 0A1514 | <.01 | .01 | <.01 | <.01 |

The billets were cut into six pieces and ultrasonic tests were performed on the hot top billet. The billet surfaces were ground to remove scale and other defects. The billets were cut to the selected length, heated to 2325° F., were hot rolled on a fourteen inch bar mill to 1⅛ inch round and then air cooled. A subsequent annealing treatment was performed at 1050° F. for six hours and air cooled. Table IX sets forth the as hot worked mechanical properties for the 09427, 09428 and OA1514 heats.

Figure 4:
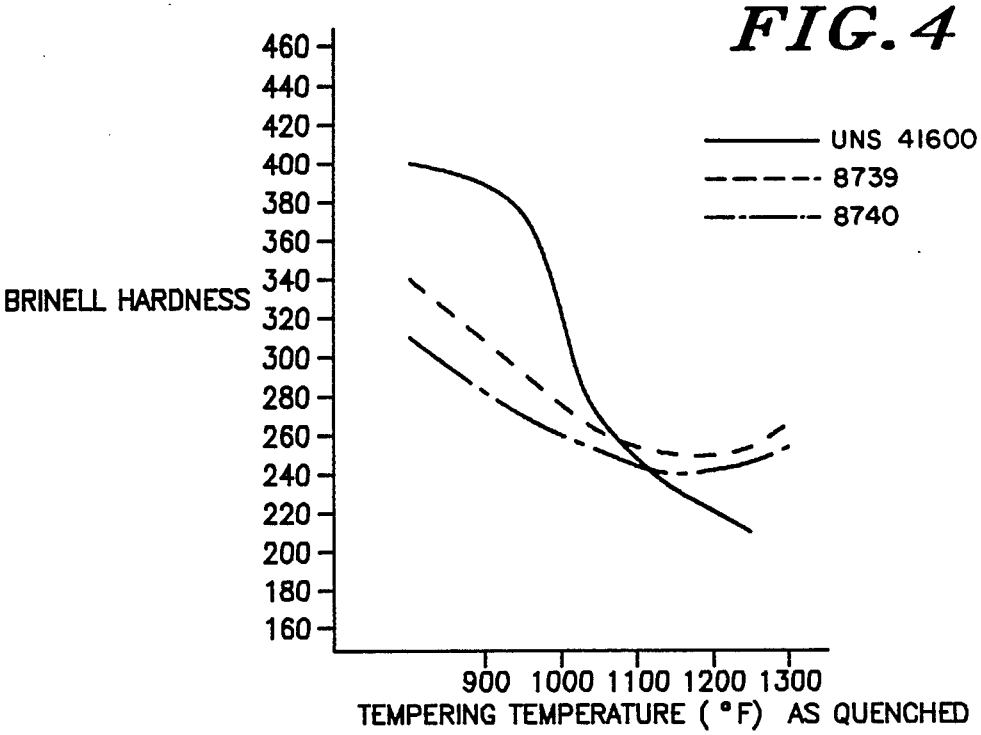
FIG. 4 illustrates Brinell Hardness Number for selected alloys tempered at various temperatures and air quenched to room temperature.

The hot worked alloys harden upon air cooling and preferably are stress relieved or tempered in the manner described above for heats 09427 and 09428 prior to making a finished part. Table X summarizes some mechanical properties of the three heats 09427, 09428 and OA1514 which have been hot worked and tempered at 1000° F. In the particular case of the heat 09427, which embodies a preferred composition, the effect on mechanical properties of tempering temperature and time are listed in Table XI. The processed material exhibits good tensile ductibility and satisfactory impact strength. It is significant that the intermediate strength level is maintained over a wide range of tempering temperatures and times. The Ni component has a significant effect on this behavior and this can be seen in FIG. 4, wherein comparison can be made between two of the preferred alloys (heats 8739 and 8740) and the commercial S41600 alloy. The UNS S41600 sample is a 12% Cr martensitic stainless steel which contains a low residual Ni content, and the hardness of this grade is highly sensitive to the tempering temperature.

A desirable tempering temperature is about 1000° F. for the alloys of Table I, Example I, and the data in Table XI indicates that the alloy heats in Table VIII can be hot worked and tempered near 1000° F. to produce the desired intermediate strength.

TABLE IX

HOT WORKED PROPERTIES

| Test Piece | Hardness |
|---|---|
| Heat No. Size | Tensile Strength BHN |
| 09427 4⅛" Sq. | 143,000 PSI 302 |
| " 1.531 × 1.031 | 139,000 PSI 311 |
| " 1⅛" Rd. | 285 |
| " 1 9/16" Sq. | 302 |
| " .531" Rd. | 153,000 PSI |
| " .275" Rd. | 156,000 PSI |
| 09428 4⅛" Sq. | 144,000 PSI 321 |
| " 1.531" × 1.031 | 138,000 PSI 311 |
| 0A1514 4⅛" Sq. | 302 |
| " 1 9/16" Sq. | 321 |
| " 1⅛" Rd. | 321 |
| " .275" Rd. | 157,000 PSI |

TABLE X

HOT WORKED PLUS 1000° F. TEMPER

| Heat Number | 09427(1⅛" rd.) | 09427 (4⅛" sq., 1¼" hex., or 1.53" × 1.03") | 09428 (1⅛" rd.) | 0A1514 (1⅛" |
|---|---|---|---|---|
| Brinell Hardness Number | 277 | 302 | 262 | 302 |
| 0.2% Yield Strength | 112,000 psi | | 114,000 psi | |
| Tensile Strength | 124,000 psi | 130,000 to 132,000 | 124,000 psi | |
| % Elongation | 21 | | 21 | |
| % Reduction or Area | 52 | | 54 | |

TABLE XI

| Heat: | 09427 |
|---|---|
| Size: | 4.125" Sq. Billet |
| Condition: | Hot Rolled |
| Test Direction: | Longitudinal |

| Condition | BHN | .2% Yield Strength | Tensile Strength | % El. | % R.A. | Charpy V Notch Impact |
|---|---|---|---|---|---|---|
| Hot Rolled | 302 | 114,000 psi | 143,000 psi | 10 | 31 | 11 ft.-lbs. |
| 900° F., 2 Hrs. A.C. | 331 | 126,000 psi | 144,000 psi | 14 | 46 | 14 ft.-lbs. |
| 900° F., 8 Hrs. A.C. | 321 | 128,000 psi | 138,000 psi | 18 | 52 | 13 ft.-lbs. |
| 900° F., 16 Hrs. A.C. | 331 | 137,500 psi | 145,500 psi | 15 | 48 | 12 ft.-lbs. |
| 950° F., 2 Hrs. A.C. | 302 | 123,500 psi | 134,000 psi | 18 | 51 | 14 ft.-lbs. |
| 1000° F., 2 Hrs. A.C. | 302 | 120,000 psi | 130,000 psi | 16 | 45 | 14 ft.-lbs. |
| 1000° F., 8 Hrs. A.C. | 277 | 116,000 psi | 124,000 psi | 20 | 53 | 16 ft.-lbs. |
| 1000° F., 16 Hrs. A.C. | 285 | 110,000 psi | 120,000 psi | 19 | 48 | 16 ft.-lbs. |
| 1050° F., 2 Hrs. A.C. | 277 | 113,500 psi | 121,500 psi | 16 | 45 | 15 ft.-lbs. |
| 1050° F., 8 Hrs. A.C. | 277 | 108,000 psi | 120,000 psi | 20 | 52 | 15 ft.-lbs. |
| 1050° F., 16 Hrs. A.C. | 269 | 108,000 psi | 118,000 psi | 17 | 50 | 19 ft.-lbs. |
| 1100° F., 2 Hrs. A.C. | 269 | 108,000 psi | 119,000 psi | 21 | 51 | 17 ft.-lbs. |
| 1150° F., 2 Hrs. A.C. | 255 | — | 118,000 psi | 21 | 55 | 16 ft.-lbs. |
| 1150° F., 8 Hrs. A.C. | 255 | 80,000 psi | 108,500 psi | 20 | 47 | 21 ft.-lbs. |
| 1150° F., 16 Hrs. A.C. | 262 | 84,000 psi | 115,000 psi | 17 | 50 | 17 ft.-lbs. |
| 1200° F., 2 Hrs. A.C. | 262 | — | 119,500 psi | 17 | 51 | 18 ft.-lbs. |

As discussed in Example I the good machinability at the intermediate strength level is a significant advantage over other commercial alloys. The good machinability associated with the instant invention is primarly a function of the amount of precipitated carbides and nitrides. Therefore, elements such as C, N, Ti, Cb, Ta and Al are preferably minimized (while controlling C to achieve the desired intermediate strength and hardness).

The machinability test is the Drill Test discussed hereinbefore for Example I. Table XII lists the effect of tempering temperature on machinability. The heat 09427 was also tempered at three different temperatures: 900° F., 1025° F. and 1150° F. The machinability of this invention over a large tempering and hardness range is superior to the S30300 alloy. The heat 09428 (see Table VII for composition) is a Cr-Ni-Cu variation of the preferred composition of this invention, and the test pieces were tempered at 1100° F., rather than solution annealed as the alloys in Table VI. Tempering produces a lower hardness and better machinability than does solution annealing; therefore, when higher Cu content alloys of this invention are tempered, the product has better machinability than the S30300 alloy. It can be generally concluded that: (1) preferred alloys of this invention have machinability equal to and usually better than the austenitic stainless steels, such as the S30300 and S30400 alloys which have about the same S level, and (2) alloys of this invention have machinability equivalent to heat treated martensitic stainless steels, such as the S41000 and S41600 alloys at about the same hardness level and S content level.

Table XIII compares the corrosion resistance of the S30300 and S41600 alloys and the 09427 and 09428 heats of the instant alloys subjected to various corrosive environments. It should be noted that the higher Cu content bearing heat 09428, which was tempered, has an anodic polarization pitting resistance in the NaCl solution comparable to the S30300 alloy.

TABLE XII

EFFECT OF TEMPERING TEMPERATURE ON MACHINABILITY DRILL SPEED VERSUS INCHES DRILLED

| Grade | Heat No. | Condition | Hardness* (BHN) | Drill Speed (SFM) 325 | 275 | 250 | 225 |
|---|---|---|---|---|---|---|---|
| Instant Alloy | 09427 | Hot Rolled + 900° F. | 302–302 | 3.0 | 17.2 | 42.7 | |
| Instant Alloy | 09427 | Hot Rolled + 1025° F. | 277–269 | 4.5 | 15.0 | | 80.2 |
| Instant Alloy | 09427 | Hot Rolled + 1150° F. | 241–255 | 6.4 | 44.2 | 81.0 | |
| Instant Alloy | 09428 | Hot Rolled + 1100° F. | 248–269 | 8.7 | 35.2 | 61.5 | |

*Hardness at Center and Edge of 4½" RCS Billet

TABLE XIII

CORROSION DATA

| Test | S30300 | S41600 | 09427 | 09428 |
|---|---|---|---|---|
| 100% Humidity, 95° F., 160 Hrs. | No Rust | 65% Rust | 1% Rust | 1% R |
| 100% Humidity, 120° F., 142 Hrs. | 30% Rust | — | 40% Rust | 50% R |
| 5% Nitric Acid, 120° F. 5–½ Hr. Periods, IPM | .00020 | .07309 | .00193 | .0002 |
| 15% Nitric Acid, 120° F. 5–½ Hr. Periods, IPM | .00038 | .00574 | .00035 | .0003 |
| 3% Acetic Acid, Boiling 2–48 Hr. Periods, IPM | .000065 | — | .000065 | No Attac |
| 0.5% Sulfuric Acid, 75° F. 2–48 Hr. Periods, IPM | .0009297 | — | .0000023 | .0000 |

TABLE XIII-continued

| Test | CORROSION DATA S30300 | S41600 | 09427 | 09428 |
|---|---|---|---|---|
| 10% Oxalic Acid, Boiling 5–48 Hr. Periods, IPM | .00420 | .21161 | .02503 | .0031 |
| Citric Acid Buffer, 3.5 pH, 120° F. 2–48 Hr. Periods, IPM | .00006 | — | .00009 | .0000 |
| 1000 ppm $Cl^-$(NaCl), pH 5, R.T. Anodic Polarization Pitting Potential | .46 | .14 | .33 | .47 |
| 1 N $H_2SO_4$, R.T. Anodic Polarization, Critical Current Density | 1.4 | 20.0 | 1.6 | 1.1 |

This corrosion data enables the following conclusions to be made: (1) the preferred alloys have better general corrosion resistance than do the 12% Cr martensitic stainless steels, (2) the preferred alloys have general corrosion resistance at least equal to and probably better than the 17% Cr ferritic stainless steels, and (3) the preferred alloys have general corrosion resistance comparable to the 18% Cr-8% Ni (18-8) austenitic stainless steels in mildly corrosive environments.

Therefore, in accordance with the present invention, there are provided martensitic-ferritic stainless steel alloys having preferred compositional ranges and microstructure providing a balance of good corrosion resistance, intermediate tensile strength, uniform hardness across a bar diameter, excellent machinability and produceable at relatively low cost. These alloys also exhibit temperability having quite broad temperatures and time of treatment.

While preferred embodiments of the present invention have been illustrated and described, it will be understood that changes and modifications can be made therein without departing from the invention in its broader aspects. Various features of the invention are defined in the following claims.

What is claimed is:

1. A wrought martensitic-ferritic stainless steel alloy consisting essentially of maximum elemental weight percentages of about 0.08C, 0.08N, 2.0Mn, 0.06P, 1.0Si, 2.5Mo, 4.0Cu, 0.10Al, 0.10Ta, 0.10Ti, 0.10Cb with the sum of said Cb, Al, Ta and Ti being at most about 0.15 weight percent, about 0.1 to 0.6 weight percent S, about 16.0 to 20.0 weight percent Cr, about 3.0 to 7.0 weight percent Ni, the remainder being Fe and including at least about 10 vol. % ferrite, said stainless steel alloy having good hot workability, good machinability, corrosion resistance superior to a S41600 stainless steel alloy and intermediate tensile strength.

2. The wrought stainless steel alloy as defined in claim 1 having a martensitic completion temperature, Mf, of at least room temperature.

3. The wrought stainless steel alloy as defined in claim 1 wherein said stainless steel alloy undergoes a heat treatment process before attaining a finished state with said stainless steel alloy having Ni and Cr Equivalents above the boundary line BD of FIG. 1 immediately prior to said heat treatment process.

4. A wrought martensitic-ferritic stainless steel alloy consisting essentially of maximum elemental weight percentages of 0.08C, 0.08N, 2.0Mn, 2.5Mo, 4.0Cu, about 0.1 to 0.6 weight percent S, about 16.0 to 20.0 weight percent Cr, about 3.0 to 7.0 weight precent Ni, at most about 0.1 weight percent each of strong carbide and/or nitride forming metals selected from the group consisting of Ti, Cb, Ta and Al, and the remainder being Fe; and said stainless steel alloy comprising a microstructure containing at most about 5 vol. % austenite and at least about 10 vol. % ferrite, and having good hot workability, good machinability, corrosion resistance superior to a S41600 stainless steel alloy and intermediate tensile strength.

5. The wrought stainless steel alloy as defined in claim 4 wherein said stainless steel alloy undergoes a mechanical cold working process before attaining a finished state with said stainless steel alloy having Ni and Cr Equivalents above the boundary line CD of FIG. 1 immediately prior to said mechanical cold working process.

6. The wrought stainless steel alloy as defined in claim 4 wherein said microstructure further contains at least about 20 vol. % martensite.

7. The wrought stainless steel alloy as defined in claim 4 wherein the amount of nickel is sufficient to achieve uniform martensitic hardening of relative large sections of said stainless steel alloy upon air cooling from hot working.

8. The wrought stainless steel alloy as defined in claim 4 wherein said alloy has a Cr Equivalent of at least about 16 and a Ni Equivalent of at least about 3.

9. A wrought martensitic-ferritic stainless steel alloy having Ni and Cr Equivalents within the area defined by ABCDE of FIG. 1 and comprising at most about 0.1 elemental weight percent each of the strong carbide and/or nitride forming metals selected from the group consisting of Al, Ti, Ta and Cb, about 0.1 to 0.6 weight percent S, about 3.0 to 7 weight percent Ni, about 16 to 20 weight percent Cr and said alloy having good workability, good machinability, corosion resistance superior to a S41600 stainless steel alloy and intermediate tensile stength.

10. The wrought stainless steel alloy as defined in claim 9 wherein said tensile strength ranges from about 100,00 to about 160,00 PSI.

11. The wrought stainless steel alloy as defined in claim 9 wherein said machinability is at least as good as S30300 austenitic stainless steel and at least as good as a S30400 austenitic stainless steel having S levels substantially the same as said stainless steel alloy.

12. The wrought stainless steel alloy as defined in claim 9 further having better corrosion resistance than a S43020 stainless steel alloy.

13. The wrought stainless steel alloy as defined in claim 9 wherein said Ni weight percentage is between about 3.0 and 7.0%, said alloy having broad temperating parameters of temperature and time.

* * * * *